US007743758B2

(12) United States Patent
Keyaki et al.

(10) Patent No.: US 7,743,758 B2
(45) Date of Patent: Jun. 29, 2010

(54) BREATHER STRUCTURE FOR INTERNAL COMBUSTION ENGINE

(75) Inventors: Shinichiro Keyaki, Saitama (JP); Toru Nishi, Saitama (JP); Kazuaki Iino, Saitama (JP); Hiromi Sumi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 241 days.

(21) Appl. No.: 11/727,565

(22) Filed: Mar. 27, 2007

(65) Prior Publication Data

US 2008/0022981 A1 Jan. 31, 2008

(30) Foreign Application Priority Data

Mar. 30, 2006 (JP) ..... 2006-094412

(51) Int. Cl.
*F02B 77/00* (2006.01)

(52) U.S. Cl. ..... 123/574; 123/41.86; 123/572; 123/573

(58) Field of Classification Search ..... 123/41.86, 123/572–574, 196 CP, 196 R, 195 AC
See application file for complete search history.

(56) References Cited

U.S. PATENT DOCUMENTS 5,690,084 A * 11/1997 Gunji et al. ..... 123/572
6,598,595 B2 * 7/2003 Yasui ..... 123/572
6,651,635 B2 * 11/2003 Kunimitsu et al. ..... 123/572
7,051,721 B2 * 5/2006 Tomita et al. ..... 123/572
7,055,509 B2 * 6/2006 Hara ..... 123/572

FOREIGN PATENT DOCUMENTS

JP 2-22451 A 2/1990

* cited by examiner

*Primary Examiner*—Michael Cuff
*Assistant Examiner*—Hung Q Nguyen
(74) *Attorney, Agent, or Firm*—Birch, Stewart, Kolasch & Birch, LLP

(57) ABSTRACT

A breather structure for internal combustion engine, the structure making a breather chamber smaller and thus making an internal combustion engine as a whole smaller. A breather chamber and a small chamber are formed. The breather chamber includes a first side face cover. The first side face cover is joined to a case to cover a first one of the right and left side faces of the case. Inside the first side face cover, an auxiliary apparatus chamber is formed. The auxiliary apparatus chamber houses a clutch mechanism connecting or disconnecting the power transmission route. Additionally, formed inside a housing are an external communication port communicating to the outside of the housing, and the small chamber communicating to a crank chamber and to the auxiliary apparatus chamber. Moreover, the auxiliary apparatus chamber communicates to the breather chamber.

20 Claims, 9 Drawing Sheets

BREATHER STRUCTURE FOR INTERNAL COMBUSTION ENGINE

CROSS-REFERENCE TO RELATED APPLICATION

The present application claims priority under 35 U.S.C. §119 to Japanese Patent Application No. 2006-094412, filed Mar. 30, 2006, the entire contents of which are hereby incorporated by reference.

BACKGROUND OF THE INVENTION

1. Field of the Invention

The present invention relates to a breather structure for an internal combustion engine with a cylinder block and a case joined to the cylinder block. The cylinder block has a cylinder bore formed therein, and a piston, which is disposed in the cylinder bore by being inserted thereinto, and which can reciprocally travel freely in the cylinder bore. Meanwhile, the case has a crank chamber communicating to the cylinder bore. A crankshaft is housed in the crank chamber, while the crankshaft rotates in conjunction with the piston.

2. Description of Background Art

In such an internal combustion engine, the internal pressure of the crank chamber, which communicates to the cylinder bore, fluctuates with the reciprocating travels of the piston. To reduce the fluctuation in the internal pressure, a breather chamber is formed to allow the inside of the housing where the internal combustion engine is housed to communicate to the outside. The mitigation of the fluctuation in the internal pressure of the crank chamber is thus pursued.

In the breather structure disclosed in Japanese Utility Model Application Laid-Open Publication No. Hei 2-22451, the crank chamber communicates to a clutch chamber housing a clutch while the clutch chamber communicates to a breather chamber. Such a breather structure, however, makes the impact of the fluctuation in the pressure in the crank chamber great because the clutch chamber directly communicates to the crank chamber. For this reason, use of a breather chamber with a larger capacity is required for mitigating the fluctuation in the pressure in the crank chamber, but this makes the capacity in total of the housing larger.

SUMMARY AND OBJECTS OF THE INVENTION

Considering such problems, an object of the present invention is to provide a breather structure for internal combustion engine made smaller in size by use of a breather chamber with a smaller capacity.

To accomplish the above object, the breather structure for internal combustion engine according to the present invention is provided in a housing of an internal combustion engine, while the engine includes a cylinder block and a case. In the cylinder block, a cylinder bore is formed so as to allow a piston to be disposed therein by being inserted into the cylinder bore, and to be capable of reciprocally traveling freely in the cylinder bore. The case is joined to the cylinder block, and inside the case, a crank chamber is formed. The crank chamber communicates to the cylinder bore, and houses a crankshaft. The crankshaft rotates in conjunction with the piston. The breather structure for internal combustion engine according to the present invention mitigates the fluctuation in the internal pressure in the crank chamber by allowing the crank chamber to communicate to the outside of the housing. A power transmission system and a first side face cover constitute the breather structure for internal combustion engine. The power transmission system is housed in the case, and includes a power transmission route. The power transmission route is constituted by a plurality of shaft members and a transmission mechanism that transmits the power among the crankshaft and the plurality of shaft members. The first side face cover is joined to the case while covering one of the right and the left side faces of the case. The first side face cover has an auxiliary apparatus chamber formed therein. Inside the auxiliary apparatus chamber, a clutch mechanism is housed, and the clutch mechanism connects and disconnects the power transmission route. Additionally, a breather chamber is formed inside the housing, with an external communication port being formed in the breather chamber to communicate to the outside. A small chamber is also formed inside the housing, and communicates both to the crank chamber and to the auxiliary apparatus chamber. Meanwhile, the clutch chamber and the breather chamber communicate to each other.

In addition, the small chamber is formed preferably inside the case. At this time, the following things are preferable: to house gears constituting the transmission mechanism in the crank chamber; to form a breather entrance port allowing the auxiliary apparatus chamber to communicate to the breather chamber on a first side of the gears; and to form a communication port allowing the small chamber to communicate to the auxiliary apparatus chamber on the second side of the gears. Moreover, an auxiliary chamber is preferably formed by delimiting in an area overlapping the gears when viewed from a side inside the auxiliary apparatus chamber, while the auxiliary chamber communicates to the auxiliary apparatus chamber through the breather entrance port and to the breather chamber through a predetermined communication port.

Furthermore, it is preferable that the small chamber be allowed to communicate to a second auxiliary apparatus chamber provided in the following configuration of the housing. The housing is joined to the case while covering the second one of the right and the left side faces, and includes a second side face cover in which the second auxiliary apparatus chamber is formed to house an auxiliary apparatus of the internal combustion engine.

EFFECTS OF THE INVENTION

In the breather structure for internal combustion engine, configured as described above, an increased internal pressure in the crank chamber is lowered once in the small chamber, and then is lowered further in the auxiliary apparatus chamber which has a large capacity, and in which the clutch mechanism is housed. As has just been described, the crank chamber does not directly communicate to the auxiliary apparatus chamber, so that the fluctuation in pressure inside the auxiliary apparatus chamber can be made smaller. Additionally, this auxiliary apparatus chamber communicates to the breather chamber, while the breather chamber communicates to the outside of the housing through the external communication port. The small chamber provided as has just been described makes the mitigation of the pressure fluctuation in the auxiliary apparatus chamber so effective that a smaller breather chamber than that of the conventional breather structure can have a sufficient breathing effect. As a result, the internal combustion engine as a whole can be made smaller in size.

Additionally, in a configuration with shaft members of the power transmission system being housed in the crank chamber, a transmission mechanism, such as gears, is provided around the shaft members. Such a configuration tends to produce a dead space in an outer peripheral portion of the transmission mechanism. The breather chamber with a smaller capacity and the smaller chamber can be provided inside the case by making use of this dead space. Such effective use of a space makes it unnecessary to provide special members dedicated to form the small chamber and the breather chamber. This simplifies the housing structure of the power transmission system and of the internal combustion engine. As a result, an internal combustion engine produced at a lower cost can be provided.

At this time, when the gears constituting the transmission mechanism of the power transmission system are housed in the crank chamber, an area, overlapping the gears when viewed from a side, is formed in the auxiliary apparatus chamber, which is formed inside the first side face cover that covers one of the right and left side faces of the case. Here, the breather entrance port that allows the auxiliary apparatus chamber to communicate to the breather chamber is formed on a first side of the gears while a communication port that allows the auxiliary apparatus chamber to communicate to the small chamber is formed on the second side of the gears. With this configuration, the distance between the breather entrance port and the communication port can be made longer than otherwise. Accordingly, making use of the space overlapping the gears when viewed from a side, mitigation of the fluctuation in the internal pressure can be carried out effectively with the auxiliary apparatus chamber. In addition, by delimiting the inside of the auxiliary apparatus chamber, the auxiliary chamber is formed in the area overlapping the gears when viewed from a side, while the auxiliary chamber is allowed to communicate to the breather chamber. Accordingly, by making use of this auxiliary chamber, further mitigation of the fluctuation in pressure is pursued, and the capacity of the breather chamber can be made even smaller.

Moreover, the small chamber communicates to the second auxiliary apparatus chamber formed inside the second side face cover, which covers the second side face of the right and the left side faces of the case. Accordingly, the second auxiliary apparatus chamber can be made use of for the purpose of mitigating the pressure. As a result, the fluctuation in the pressure inside the clutch chamber can further be mitigated, and the capacity of the breather chamber can be made still even smaller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
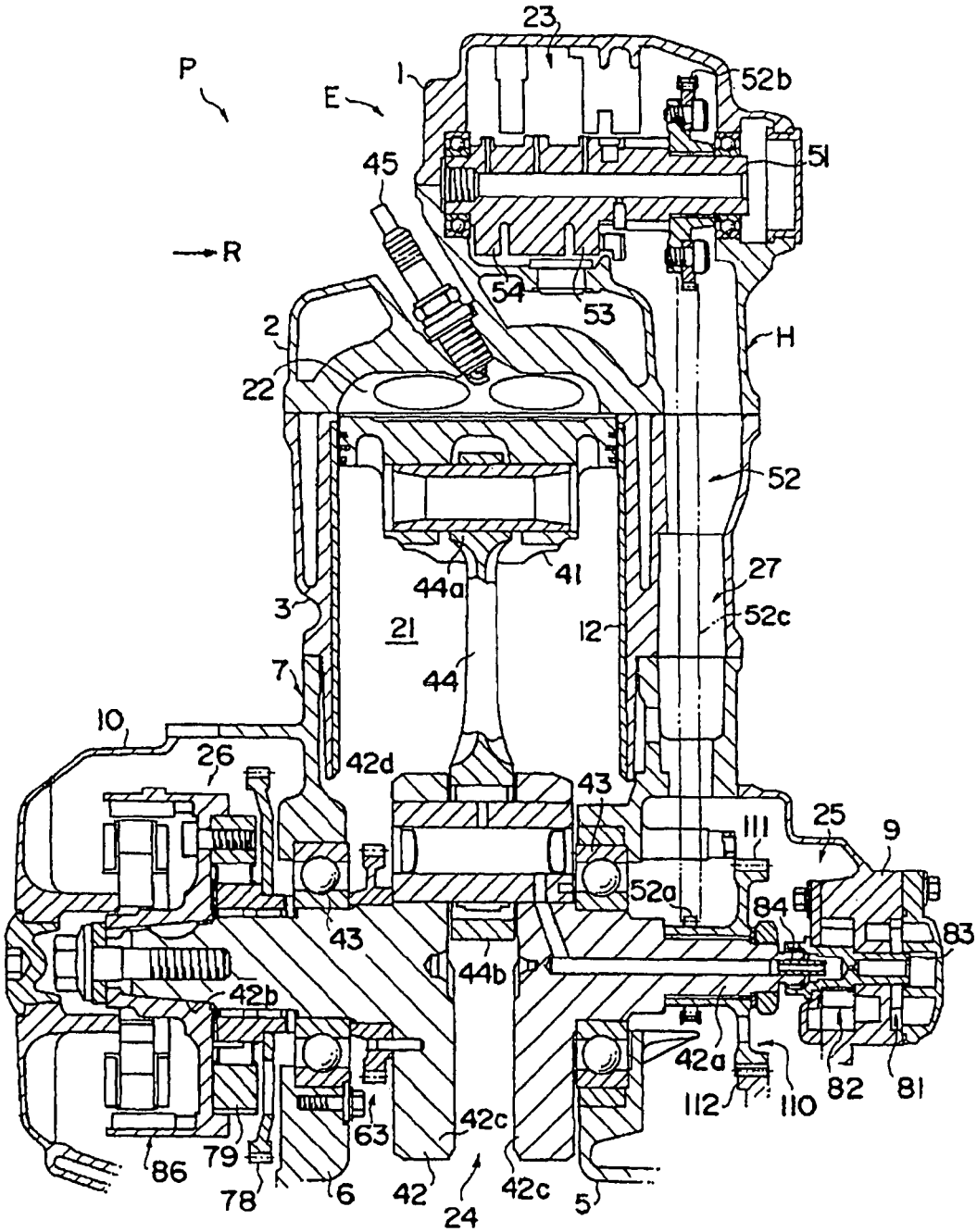
FIG. 1 is a cross-sectional view of a power unit in which a breather structure for internal combustion engine according to the present invention is provided.

FIG. 1 to FIG. 5 illustrate a power unit P of a saddle-ride type vehicle equipped with a breather structure for internal combustion engine according to the present invention. In the figures, an arrow U indicates the upward direction; an arrow F, the forward direction; and an arrow R, the rightward direction. The directions indicated by these arrows correspond to the directions from the viewpoint of the driver of the saddle-ride type vehicle. Examples of the saddle-ride type vehicle include a motorcycle and an all-terrain buggy.

The power unit P includes components in and outside of a housing H. The housing H is formed by assembling a head cover 1, a cylinder head 2, a cylinder block 3 and a crankcase 4 into one. Specifically, the cylinder head 2 is joined to the top of the cylinder block 3. The head cover 1 is joined to the cylinder head 2 so as to cover the cylinder head 2. The crankcase 4 is joined to the bottom of the cylinder block 3.

FIG. 2 and FIGS. 6 to 8 show that the crankcase 4 can be halved into right and left halves, or, in other words, the crankcase 4 is formed by assembling a right case 5 and a left case 6 together. A side face of the right case 5 constitutes the right side face of the crankcase 4, while a side face of the left case 6 constitutes the left side face of the crankcase 4. The crankcase 4 is provided beneath the cylinder block 3, and extends therefrom rearwards. A transmission case 8 is formed integrally with the crankcase 4 at the rear portion thereof. The transmission case 8 includes central separation walls 5*a* and 6*a* formed respectively in the right case 5 and in the left case 6. The transmission case 8 also includes rear wall portions 5*e* and 6*e*, upper wall portions 5*g* and 6*g*, and separation walls 5*i* and 6*i*, all of which are parts of the crankcase 4.

A ribbed attachment 5*n* for right cover is formed surroundingly on the right side face of the right case 5. A right cover 9 is aligned to and is attached to the ribbed attachment 5*n* for right cover while the right cover 9 covers the right side face of the right case 5. Additionally, a ribbed attachment 6*n* for left cover is formed surroundingly in a front portion of the left side face of the left case 6. A left cover 10 is aligned to and is attached to the ribbed attachment 6*n* for left cover while the left cover 10 covers the left side face of the left case 6. Moreover, a ribbed attachment 6*o* for gear case is formed surroundingly in a rear portion of the left side face of the left case 6. A gear case 11 (see FIG. 4) is aligned to and is attached to the ribbed attachment 6*o* for gear case while the gear case 11 covers the left side face of the left case 6.

The housing H includes: a cylinder bore 21 formed inside the cylinder block 3; a combustion chamber 22 formed above the cylinder bore 21; a valve chamber 23 formed inside the head cover 1 and the cylinder head 2; a crank chamber 24 formed inside a crankcase 4; a right auxiliary apparatus chamber 25 surrounded by the right case 5 and right cover 9; a left auxiliary apparatus chamber 26 surrounded by the left case 6 and left cover 10; a chain chamber 27 allowing the valve chamber 23 and the right auxiliary apparatus chamber 25 to communicate to each other; a transmission chamber 28 formed inside the transmission case 8; and a final gear chamber 29 surrounded by the left case 6 and the gear case 11. In addition to these listed above, a breather chamber 30 and an oil reservoir 35 are formed inside the housing H. The oil reservoir 35 is in a position below the transmission chamber 28 and is formed to be surrounded by bottom wall portions 5*f* and 6*f* of the crankcase 4, and by bottom end portions of the respective central separation walls 5*a* and 6*a*. Lubricating oil is stored inside the oil reservoir 35.

A reciprocating engine E and a power transmission system M constitute the power unit P. The reciprocating engine E is a single-cylinder, four-stroke engine. The power transmission system M includes a chain drive mechanism 175 and a transmission mechanism 120 by which a speed can selectively be set from five forward speeds and one reverse. The head cover 1, the cylinder head 2, the cylinder block 3, the crankcase 4, the right cover 9 and the left cover 10 constitute the housing for the engine E. In and outside of these, components and auxiliary apparatuses are provided. The transmission case 8, the right case 9 and the gear case 11 constitute the housing for the power transmission system M. In and outside of these, components are provided.

To begin with, descriptions of the engine E will be given. As being shown in FIG. 1, a cylindrical space with openings on either up and down sides is formed in the cylinder block 3. A cylinder sleeve 12, also with a cylindrical shape and with openings on either up and down sides, is fitted into the cylindrical space from the bottom. In this way, the cylinder bore 21 is formed inside the cylinder block 3, while the cylinder bore 21 with openings on either up and down sides is surrounded by the inner circumferential surface of the cylinder sleeve 12. A piston 41 is disposed in the cylinder bore 21 by being inserted thereinto. The piston 41 can slide freely in the axial directions of the cylinder bore 21 on the inner circumferential surface of the cylinder sleeve 12.

A crankshaft 42 extending in the right and left directions is supported in the crankcase 4 while the crankshaft 42 can rotate freely. Bearings 43, 43 for supporting the crankshaft 42 are respectively attached to the right case 5 and the left case 6. Specifically, each bearing 43 is installed in a space formed through the side face of each of the right and the left cases 5 and 6. The crankshaft 42 is housed in the following way. The parts located at the center of the crankshaft 42, specifically, two web portions 42*c*, 42*c* and a pin portion 42*d* are housed in the crank chamber 24. A right end portion 42*a*, sticking out from the side face of the right case 5, is housed in the right auxiliary apparatus chamber 25, while the left end portion 42*b*, sticking out from the side face of the left case 6, is housed in the left auxiliary apparatus chamber 26.

A connecting rod 44 connects the piston 41 and the crankshaft 42. A small end portion 44*a* of the connecting rod 44 is pivotally fixed to the piston 41, while the big end portion 44*b* is pivotally fixed to the pin portion 42*d* of the crankshaft 42. Accordingly, the piston 41 reciprocally travels in conjunction with the rotation of the crankshaft 42, and thus the crankshaft 42 functions as the output shaft of the engine E.

The cylinder head 2 is attached to the cylinder block 3 while the cylinder head 2 covers the cylinder bore 22 from the above. Accordingly, the combustion chamber 22 is formed as being surrounded by the bottom surface of the cylinder head 2, the inner circumferential surface of the cylinder sleeve 12 and the upper face of the piston 41. A spark plug 45 is attached to the cylinder head 2, with the electrode portion of the spark plug 45 facing the center of the combustion chamber 22. In addition, an intake passage 31 and an exhaust passage 32 are formed inside the cylinder head 2. Each of the intake and the exhaust passages 31 and 32 allows the combustion chamber 22 to communicate to the outside. An intake valve 46 opens and closes an intake port 33*a* which is an opening in the combustion chamber 22, and which leads to the intake passage 31. Meanwhile, an exhaust valve 47 opens and closes an exhaust port 34*a* which is an opening in the combustion chamber 22, and which leads to the exhaust passage 32. Both of the intake and the exhaust valves 46 and 47 are housed in the valve chamber 23. The intake valve 46 is biased upwards by a valve spring 46*a* and is normally shut the intake port 33*a*. Meanwhile, the exhaust valve 47 is biased upwards by a valve spring 47*a*, and is normally shut the exhaust port 34*a*.

The intake and exhaust valves 46 and 47 are driven by a valve mechanism, which includes a cam shaft 51. The cam shaft 51 extends in the right and left directions on a surface that divides the head cover 1 from the cylinder head 2, and the cam shaft 51 is supported as being capable of rotating freely. A chain transmission mechanism 52, an intake cam 53, an exhaust cam 54, an intake rocker arm 55, and an exhaust rocker arm 56 constitute the valve mechanism. The chain transmission mechanism 52 is housed in the chain chamber 27. Both of the intake cam 53 and the exhaust cam 54 are provided on the cam shaft 51. The intake rocker arm 55 has a first end touching the intake cam 53 and a second end touching the upper end of the intake valve 46. The exhaust rocker arm 56 has a first end touching the exhaust cam 54 and a second end touching the upper end of the exhaust valve 47. A drive sprocket 52*a*, a driven sprocket 52*b*, and a cam chain 52*c* constitute the chain transmission mechanism 52. The drive sprocket 52*a* is connected to the crankshaft 42, while the driven sprocket 52*b* is connected to the cam shaft 51. The cam chain 52*c* is looped between the two sprockets 52*a* and 52*b*. Arm shafts 57 and 58 are securely installed inside the valve chamber 23, and the two rocker arms 55 and 56 are pivotally fixed to the arm shafts 57 and 58 respectively.

Rotation of the crankshaft 42 makes the cam shaft 51 rotate with a rotating speed reduced to half the speed of the crankshaft 42 by the power transmission process with the chain transmission mechanism 52. With the rotation of the cam shaft 51, the cams 53 and 54 operate to make the rocker arms 55 and 56 swing, respectively. Accordingly, the intake and the exhaust valves 46 and 47 are pushed downwards against the biasing force respectively of the valve springs 46*a* and 47*a*. As a result, the intake and the exhaust ports 33*a* and 34*a* are opened.

Note that an unillustrated chain tensioner that applies a tension to the cam chain 52*c* is attached to the cylinder block 3 from the outside. Additionally, an intake-valve cover 13 and an exhaust-valve cover 14 are attached to the head cover 1 so that the covers 13 and 14 can cover the openings formed in the upper wall face of the head cover 1. When the intake-valve cover 13 is detached, the upper end of the intake valve 46 and the second end of the intake rocker arm 55, which are installed in the valve chamber 23, can be seen through the opening of the head cover 1. When the exhaust-valve cover 14 is detached, the upper end of the exhaust valve 47 and the second end of the exhaust rocker arm 56 can be seen in the same manner.

The intake passage 31 has a connecting port 33*b* to connect the intake passage 31 to the outside, and an intake pipe is provided to the connecting port 33*b*. An air cleaner is provided at the upstream end of the intake pipe, allowing filtered air to be introduced to the intake pipe. An unillustrated carburetor is provided in a downstream portion of the intake pipe, and thus air-fuel mixture formed of the filtered air containing the fuel turned into a fine mist is introduced to the intake passage 31. Note that the exhaust passage 32 has a connecting port 34*b* to connect the exhaust passage 32 to the outside, and an unillustrated exhaust pipe is provided to the connecting port 34*b*. As a result, the exhaust passage 32 communicates to the outside via an unillustrated muffler attached to the rear bottom portion of the vehicle.

Figure 2:
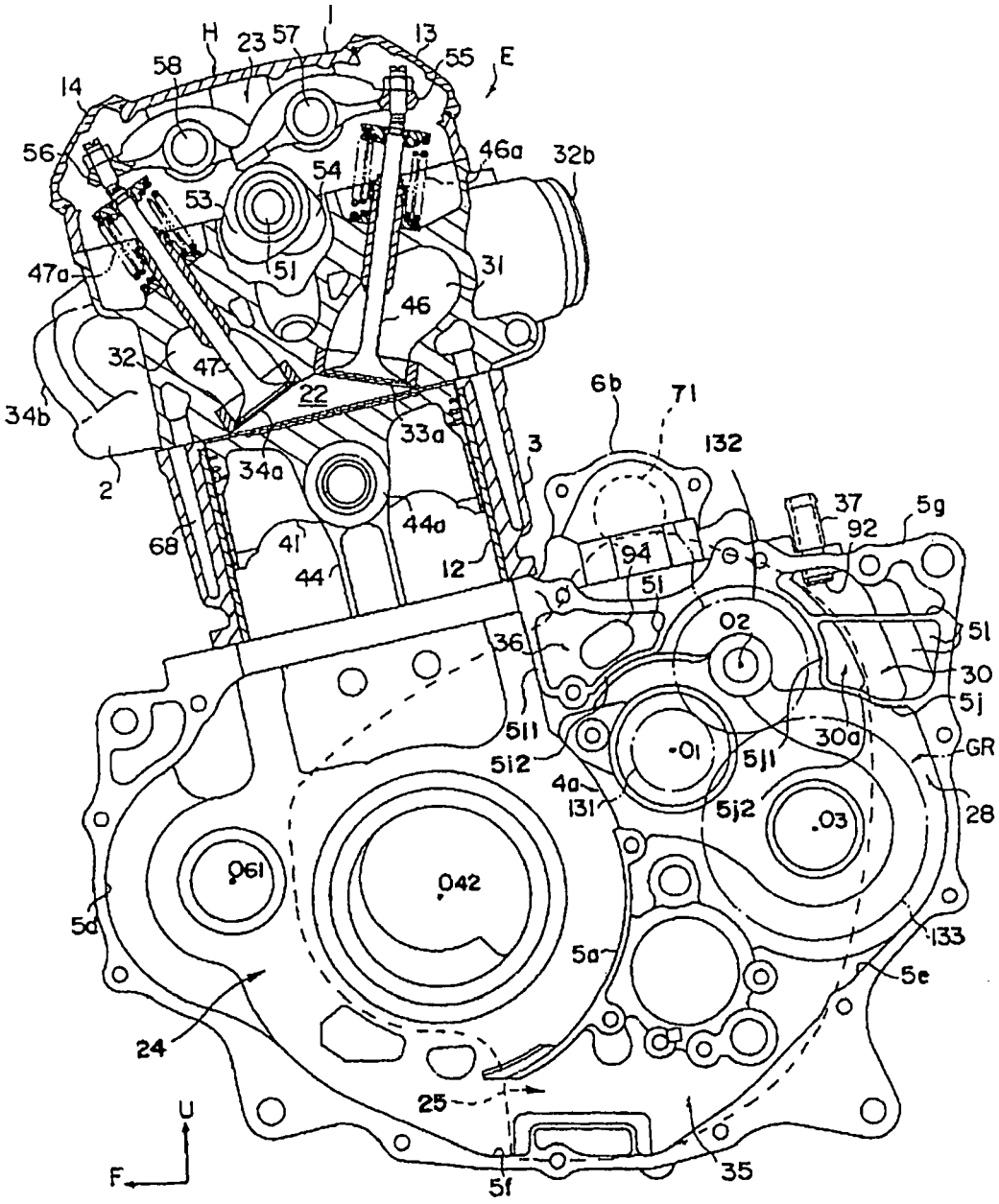
FIG. 2 is a cross-sectional view of the power unit, showing a left side cross-sectional view of a cylinder block and of a cylinder head, as well as a left side view of a right case.
Figure 3:
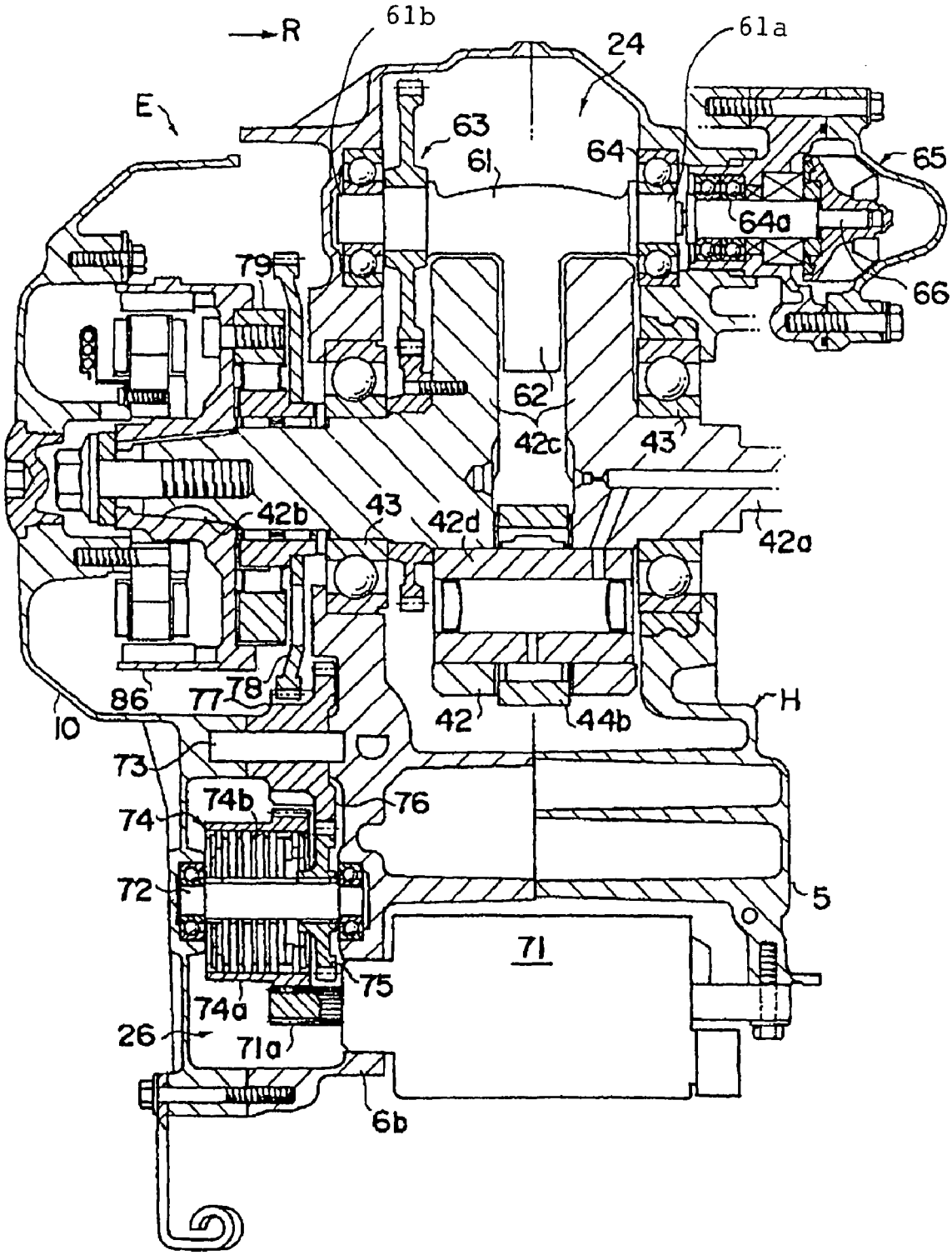
FIG. 3 is a cross-sectional view of an engine of the power unit.

A balancer shaft 61, which is supported as being capable of rotating freely, extends in the right and left directions and is housed in the crank chamber 24. A balancer weight 62 is provided to the balancer shaft 61. FIG. 2 shows the position of the shaft center $O_{61}$ of the balancer shaft 61. FIG. 2 shows that the balancer shaft 61 is positioned ahead of the crankshaft 42 ($O_{42}$). FIG. 3 shows that the balancer weight 62 is placed between the two web portions 42*c*, 42*c* of the crankshaft 42. The balancer shaft 61 is driven by the crankshaft 42 through the transmission of power with a balancer gear train 63 housed inside the crank chamber 24. Thus, the balancer shaft 61 rotates at a speed that is equal to the rotating speed of the crankshaft 42, and the balancer shaft 61 functions as a primary balancer shaft. The balancer shaft 61 has a right end portion 61*a* supported by the right case 5, and a left end portion 61*b* supported by the left case 6.

A bearing 64 is provided to support the right end portion 61*a* of the balancer shaft 61. An attachment space 64*a* for the bearing 64 has an opening facing towards the right (the outside). A water pump 65 is attached to the space 64*a* from the outer side. A drive shaft 66 of the water pump 65 is coupled to the balancer shaft 61 with a joint.

Figure 7:
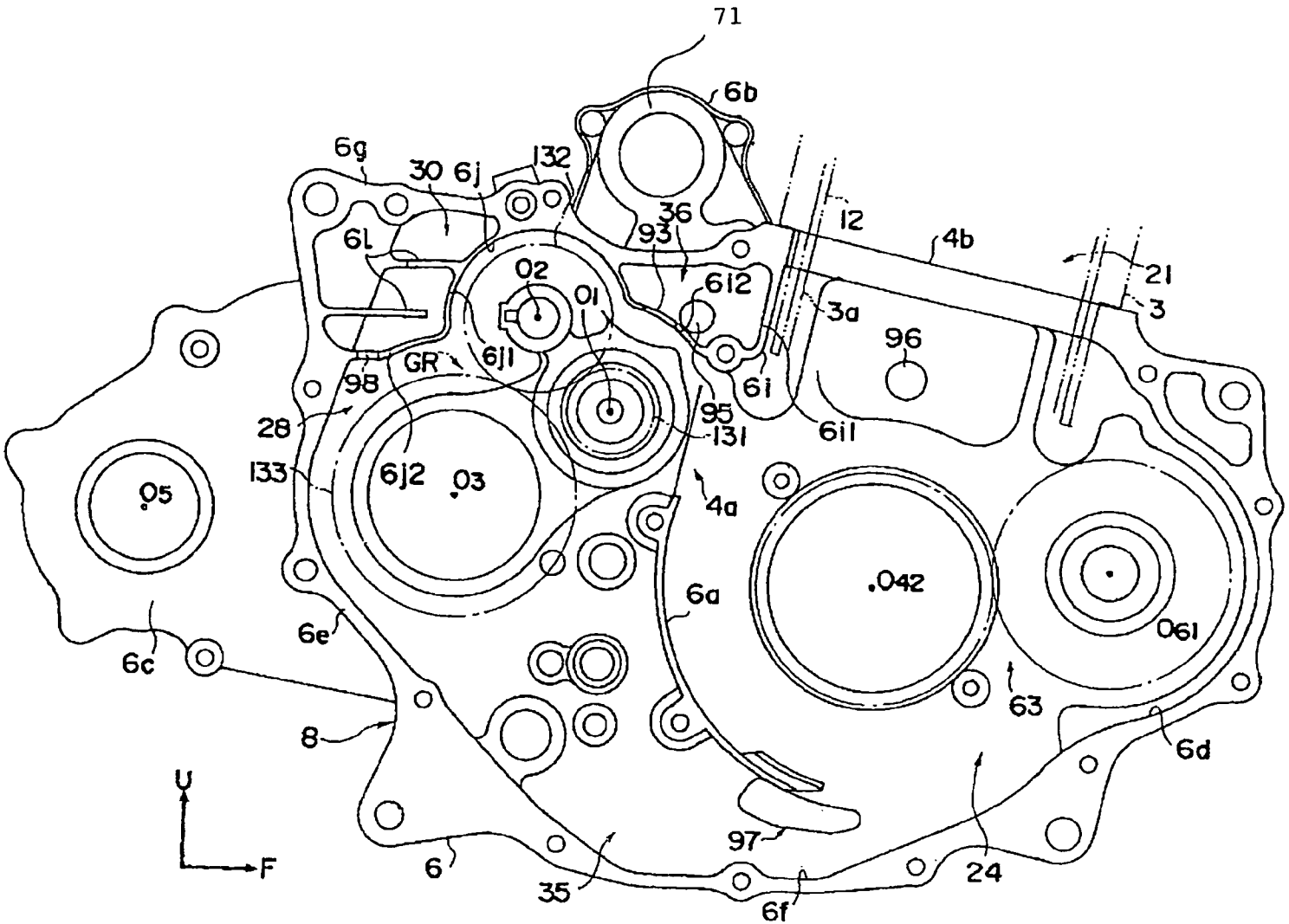
FIG. 7 is a right side view of the left case.
Figure 8:
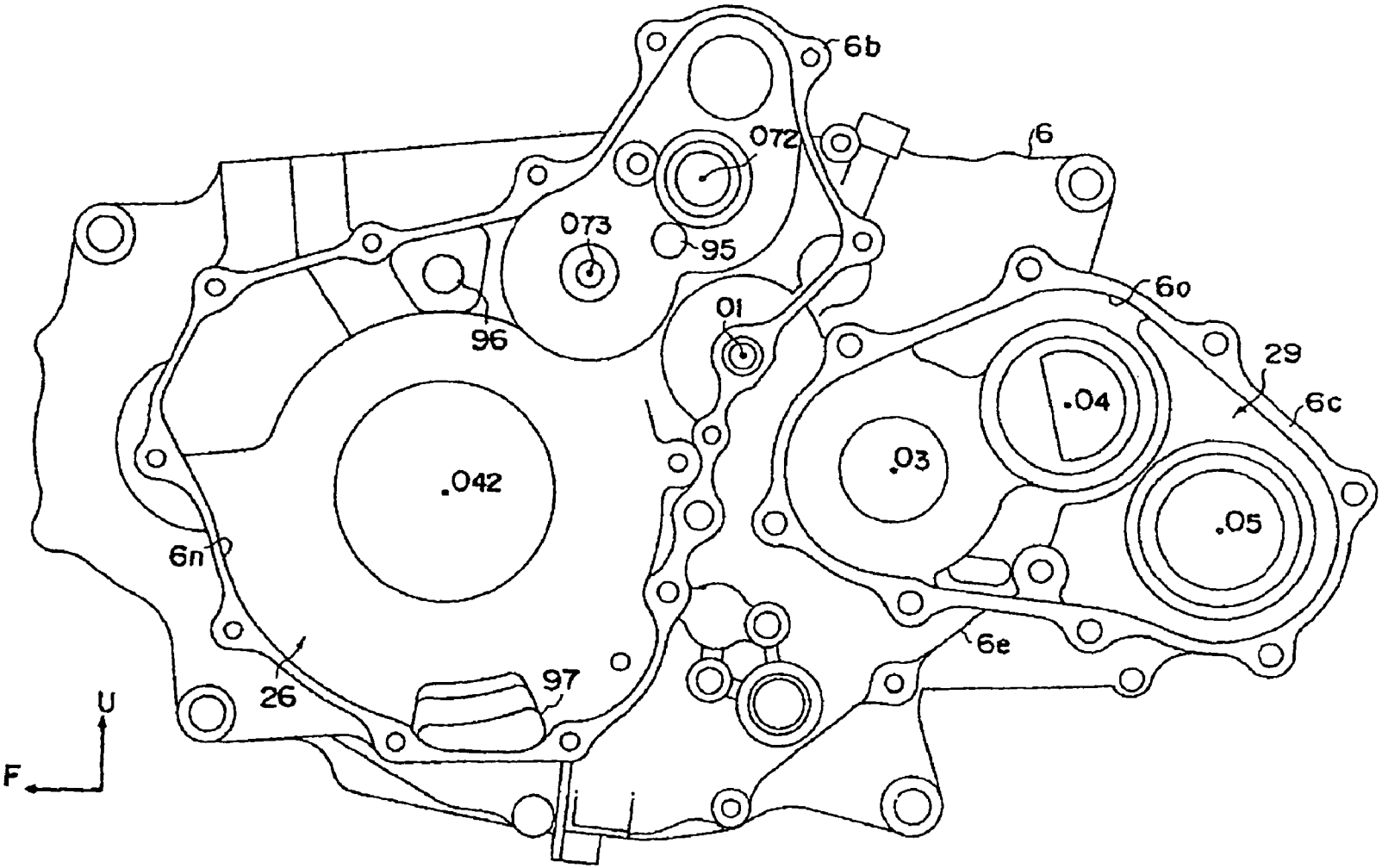
FIG. 8 is a left side view of the left case.

In addition, as being shown in FIG. 2, FIG. 7 and FIG. 8, a motor bracket 6*b* is formed, integrally with the left case 6, as extending from the upper wall portion 6*g* towards a portion behind the cylinder block 3 (i.e. towards a portion above the crankcase 4). A starter motor 71 is attached to the motor bracket 6*b* from the right side of the motor bracket 6*b*. An unillustrated battery supplies the electric power to drive the starter motor 71. The left cover 10 covers the left side face of the motor bracket 6*b*, and thus the left auxiliary apparatus chamber 26 is formed as extending in the same direction as that the motor bracket 6*b* extends. Installed in the left auxiliary apparatus chamber 26 including the above-mentioned extended part, is a starter reduction mechanism, which transmits the driving force from the starter motor 71 to the crankshaft 42. The starter reduction mechanism includes a first idle shaft 72 and a second idle shaft 73. The starter reduction mechanism also includes a torque limiter 74. The torque limiter 74 includes an outer rotor 74*a* and an inner rotor 74*b*. The outer rotor 74*a* is provided on the first starter idle shaft 72 as being capable of freely rotating relatively to the first starter idle shaft 72, and meshes with a pinion 71*a* of the starter motor 71. The inner rotor 74*b* is coupled to the first starter idle shaft 72. The starter reduction mechanism further includes a first starter gear 75, coupled to the inner rotor 74*b*, and rotating on the first starter idle shaft 72; and a second starter gear 76, meshing with the first starter gear 75, and rotating on the second starter idle shaft 73. The starter reduction mechanism still further includes a third starter gear 77, formed integrally with the second starter gear 76, and rotating on the second starter idle shaft 73; and a fourth starter gear 78, meshing with the third starter gear 77, and coupled to the left end portion 42*b* of the crankshaft 42 via a one-way clutch 79. The first and the second idle shaft 72 and 73 are placed in positions, as their respective shaft centers $O_{72}$ and $O_{73}$ being shown in FIG. 8, behind and above the crankshaft 42 ($O_{42}$) (i.e., in front of and above a main shaft 101 ($O_1$)). The left case 6 supports right end portions 72*a* and 73*a* respectively of the first and the second idle shafts 72 and 73 while the left cover 10 supports left end portions 72*b* and 73*b* respectively of the first and the second idle shafts 72 and 73.

Note that, as being shown in FIG. 1, an AC generator 86 driven by the crankshaft 42 is provided at the left end of the crankshaft 42, while being housed in the left auxiliary apparatus chamber 26. Moreover, though not being illustrated, a recoil starter, engaging with the crankshaft 42, is attached to the left side of the AC generator 86. A trochoid feed pump 81 and a scavenging pump 82 are provided at the right end of the crankshaft 42, while being housed in the right auxiliary apparatus chamber 25. A drive shaft 83 of these two pumps 81 and 82 is coupled to the crankshaft 42 with a tubing 84. The two pumps 81 and 82 are oil pumps to circulate lubricating oil.

When the starter motor 71 is driven and the driving force is transmitted from the starter motor 71 to the crankshaft 42 by the starter reduction mechanism, the engine E starts. When the starter motor 71 drives the crankshaft 42, the piston 41, interlocked with the crankshaft 42, travels reciprocally inside the cylinder bore 21 in the axial directions. A movement of the piston 41 downward from the top dead center makes the intake valve 46 open the intake port 33*a* by the operation of the intake cam 53, and thus the air-fuel mixture is supplied to the combustion chamber 22 (intake stroke). A movement of the piston 41 downward closely to the bottom dead center makes the intake valve 46 shut the intake port 33*a*. A movement of the piston 41 upward from the bottom dead center makes the air-fuel mixture introduced to the combustion chamber 22 be compressed (compression stroke). A movement of the piston 41 upward closely to the top dead center actuates the spark plug 45 to ignite the compressed air-fuel mixture, and then the piston 41 moves downwards again (expansion stroke). A movement of the piston 41 downward closely to the bottom dead center makes the exhaust valve 47 open the exhaust port 34*a* by the operation of the exhaust cam 54, and thus the gas in the combustion chamber 22 is discharged through the exhaust port 34*a* (exhaust stroke). A movement of the piston 41 upward closely to the top dead center makes the exhaust valve 47 shut the exhaust port 34*a*, and makes the intake valve 46 open the intake port 33*a*.

Every two reciprocating travels of the piston 41 (i.e. every two rotations of the crankshaft 42) give a round of this series of strokes, i.e. from the intake stroke to the exhaust stroke. Note that when the crankshaft 42 rotates faster than a certain predetermined speed, the one-way clutch 79 slips, and thus the power transmission from the fourth starter gear 78 to the crankshaft 42 is cut off. Note that even when a kickback towards the starter motor 71 takes place, no excessive torque is allowed to be transmitted from the first starter gear 75 to the pinion 71*a*, thanks to the operation of the torque limiter 74. In addition, rotation of the crankshaft 42 drives the AC generator 86, and then electric power to be supplied to the vehicle electrical systems, is generated. As a result, the feed pump 81 and the scavenging pump 82 are driven, so that the lubricating oil is supplied to each part of the power unit P. Moreover, power transmission through the balancer gear train 63 drives the balancer shaft 61. This alleviates the vibration due to the reciprocating travels of the piston 41, and drives the water pump 65 to circulate the cooling water to cool down the parts around the cylinder bore 21.

Figure 4:
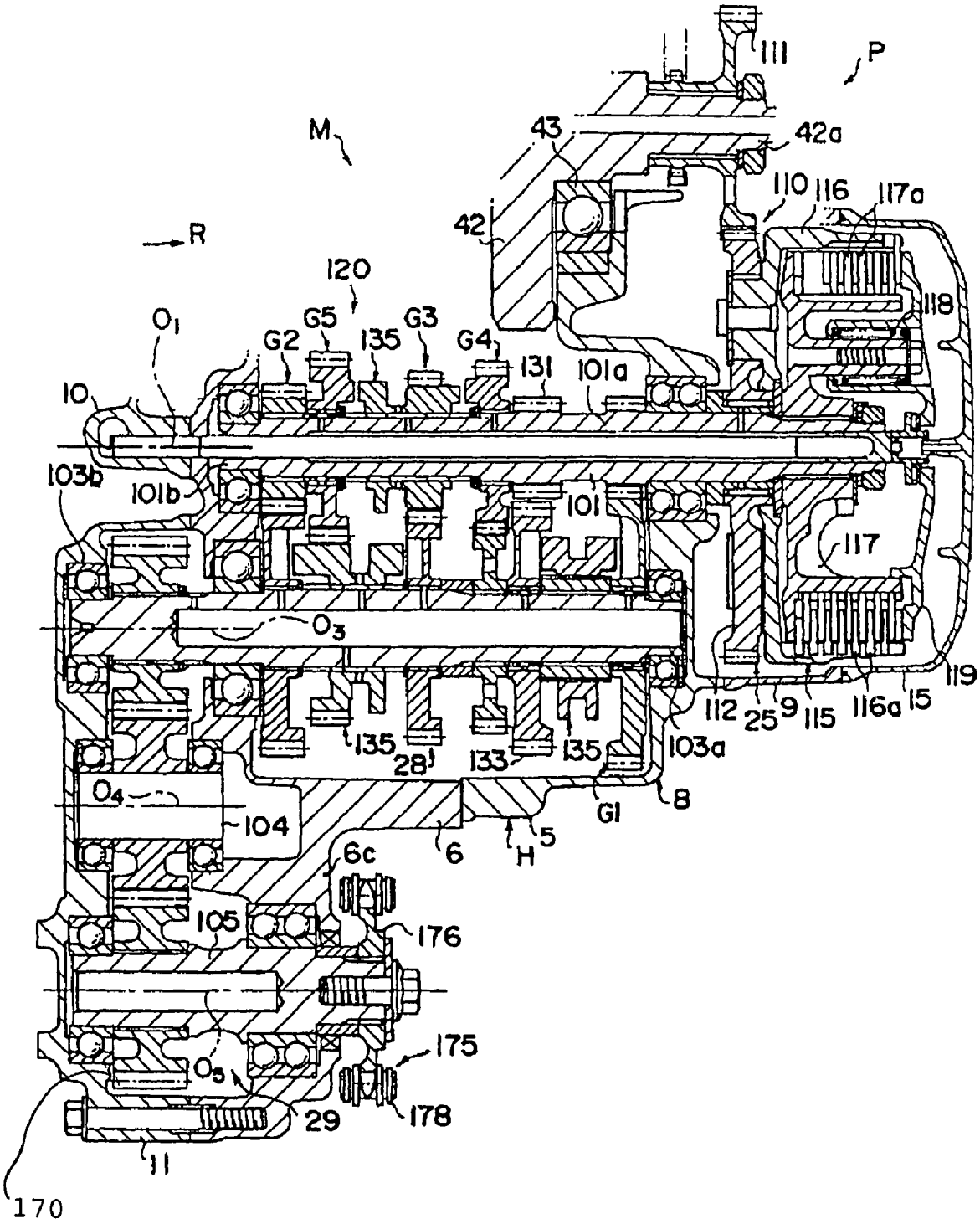
FIG. 4 is a cross-sectional view of a power transmission mechanism of the power unit.
Figure 5:
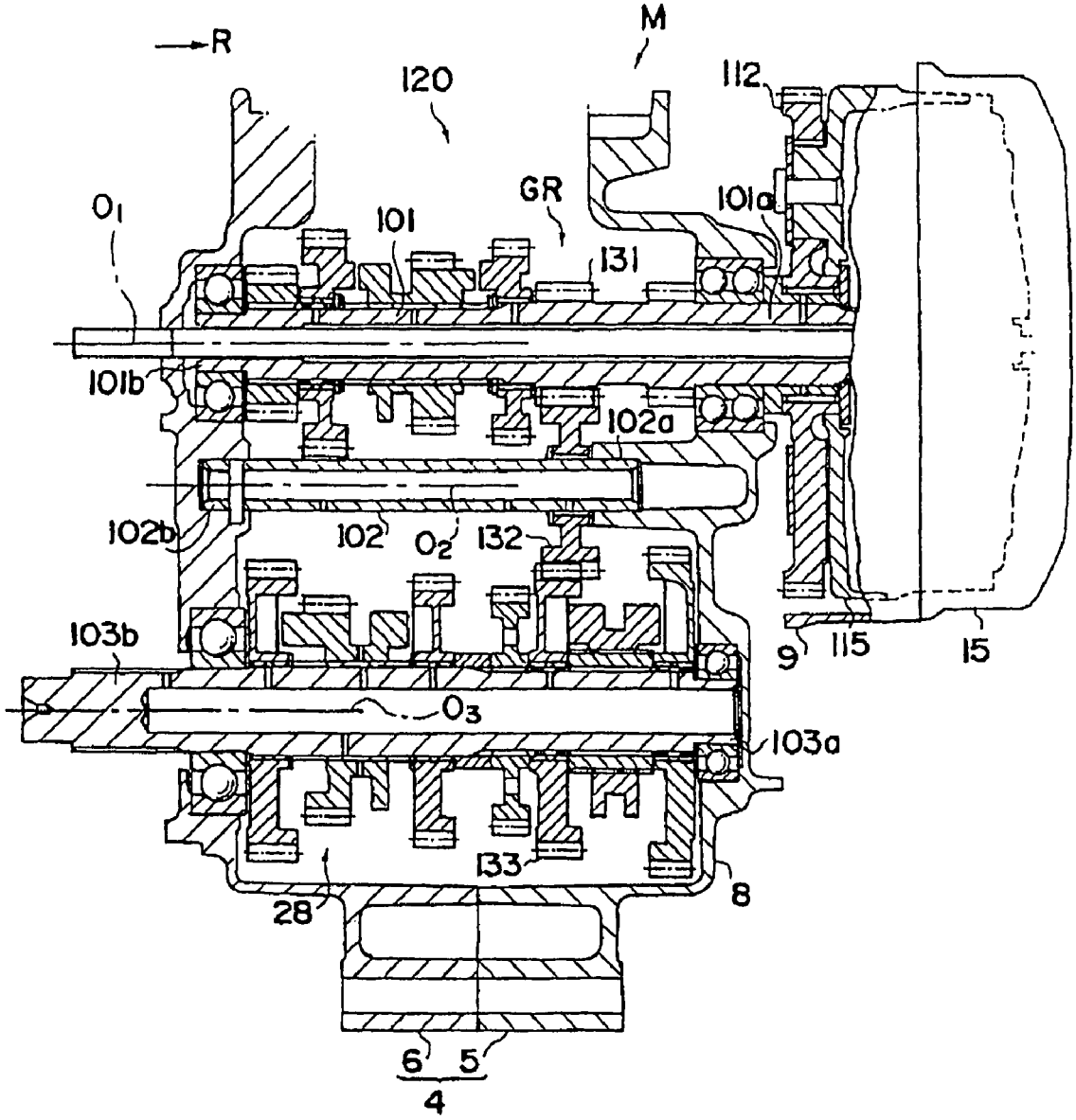
FIG. 5 is a cross-sectional view of the power transmission mechanism of the power unit.

On the other hand, the power transmission system M, as is shown in FIG. 4 and FIG. 5, includes the main shaft 101, a reverse idle shaft 102, a counter shaft 103, a final idle shaft 104, and an output shaft 105, all of which are parallel to the crankshaft 42 (extending in the right and left directions).

Note that a gear bracket 6c, extending further rearwards from the rear wall portion 6*e* of the transmission case 8, is formed integrally to the left case 6. The ribbed attachment for gear case 6*o* is formed also across the gear bracket 6*c*, so that the gear case 11 is joined also to the left side face of the gear bracket 6*c*.

The main shaft 101, capable of rotating freely, is housed in the transmission chamber 28, with the left end portion 101*b* supported by the left case 6 and the right end portion 101*a* supported by the right case 5 and sticking out to the inside of the right auxiliary apparatus chamber 25. The reverse idle shaft 102 is a fixed shaft housed in the transmission chamber 28, with a right end portion 102*a* supported by the right case 5 and a left end portion 102*b* supported by the left case 6. The counter shaft 103, capable of rotating freely, is housed in the transmission chamber 28 with the right end portion 103*a* supported by the right case 5 and the left end portion 103*b* supported by the left case 6 and sticking out to the inside of the final gear chamber 29. The final idle shaft 104, capable of rotating freely, is housed in the final gear chamber 29 with the right end portion 104*a* supported by the gear bracket 6*c* and the left end portion 104*b* supported by the gear case 11. The output shaft 105, capable of rotating freely, is housed in the final gear chamber 29 with the right end portion 105*a* supported by the gear bracket 6*c* and the left end portion 105*b* supported by the gear case 11.

As being shown in FIG. 2, the main shaft 101, the reverse idle shaft 102 and the counter shaft 103 are housed in an upper portion of the transmission chamber 28. The counter shaft 103, the final idle shaft 104 and the output shaft 105 are placed in positions, as their respective shaft centers $O_3$, $O_4$ and $O_5$ being shown in FIG. 8, inside the final gear chamber 29. The three shafts 103, 104, and 105 are placed in a way that the final idle shaft 104 is placed between the counter shaft 103 and the output shaft 105, and above the two shafts 103 and 105.

A primary gear train 110 and a main clutch 115, housed in the right auxiliary apparatus chamber 25, are provided between the crankshaft 42 and the main shaft 101. Five forward-speed gear trains G1 to G5, housed in the transmission chamber 28, are provided between the main shaft 101 and the counter shaft 103. A reverse-speed gear train GR, housed in an upper portion of the transmission chamber 28, is also provided between the main shaft 101 and the counter shaft 103 with the reverse idle shaft 102. A final gear train 170, housed in the final gear chamber 29, is provided between the counter shaft 103 and the output shaft 105 with the final idle shaft 104. A chain drive mechanism 175 is provided outside the housing H, and between the output shaft 105 and an unillustrated rear wheel.

A primary drive gear 111 and a primary driven gear 112 constitute the primary gear train 110. The primary drive gear 111 is coupled to the right end portion 42*a* of the crankshaft 42. The primary driven gear 112 meshes with the primary drive gear 111 and is provided on the right end portion 101*a* of the main shaft 101 so as to be capable of rotating freely relatively to the main shaft 101. The main clutch 115 is composed of an outer rotor 116, coupled to the primary driven gear 112, and an inner rotor 117, connected to the main shaft 101. When a piston 119 is pressed in an axial direction against the biasing force of a spring 118, clutch disks 116*a* and 117*a*, provided respectively to the outer rotor 116 and the inner rotor 117, engage with each other, and thus the rotation of the crankshaft 42 can be transmitted to the main shaft 101. In contrast, when the piston 119 is biased by the spring 118, the clutch disks 116*a* and 117*a* disengage, and thus the transmission of the power from the primary driven gear 112 to the main shaft 101 is cut off. Note that part of the right cover 9, specifically the part covering the main clutch 115, has an opening, and a clutch cover 15 is attached to the right cover 9 from the right side so as to cover the opening portion of the right cover 9.

A transmission mechanism 120 is housed in the transmission chamber 28. The above-mentioned six gear trains G1 to G5 and GR, dog clutch mechanisms 135, and an unillustrated shift change mechanism constitute the transmission mechanism 120. The unillustrated shift change mechanism actuates the dog clutch mechanism 135. The dog clutch mechanisms 135 functions to select any one of these six gear trains G1 to G5 and GR, and then to make the selected gear train rotate integrally with the main shaft 101 and the counter shaft 103. In each of the six gear trains G1 to G5 and GR, a first one of the gears provided on the main shaft 101 and the counter shaft 103 rotates integrally with the corresponding shaft, while the second one of the gears is provided so as to rotate relatively to the corresponding shaft. In each gear train, the two gears constantly mesh with each other, and an operation of the corresponding dog clutch mechanisms 135 makes the gear that is capable of rotating relatively to the shaft rotate integrally with the shaft. As is indicated by the configuration, the transmission mechanism 120 is a constant-mesh type transmission mechanism capable of selecting from five forward speeds and a reverse speed.

In the power transmission system M, the rotation of the crankshaft 42 is transmitted to the main shaft 101 with the primary gear train 110 and the main clutch 115. The rotation of the main shaft 101 is transmitted to the counter shaft 103 with one of the gear trains, the one being selected by the transmission mechanism 120. The rotation of the counter shaft 103 is transmitted to the output shaft 105 with the final gear train 170. Then, the rotation of the output shaft 105 is transmitted to the rear wheel with the chain drive mechanism 175, and thus the vehicle can run.

Figure 9:
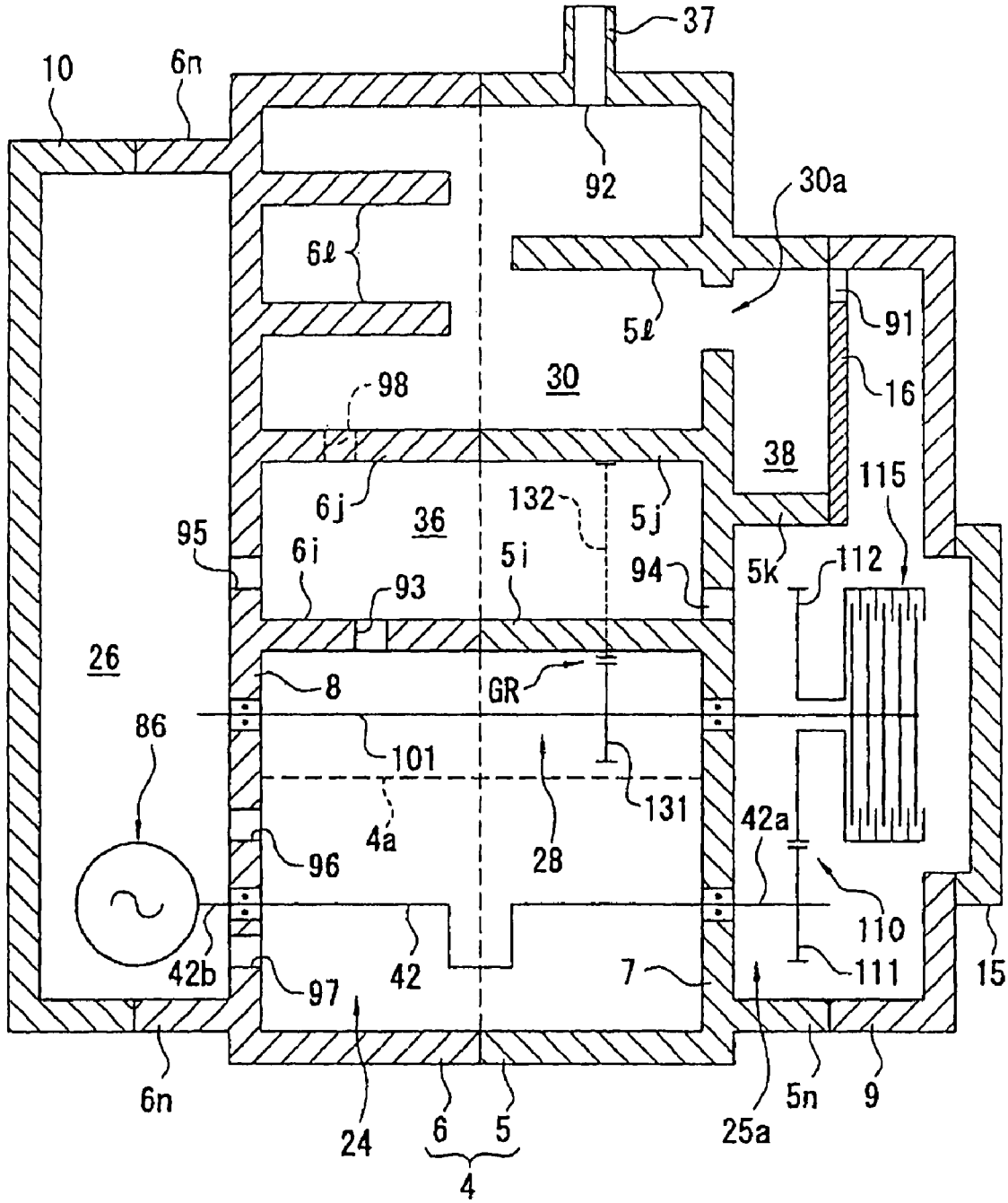
FIG. 9 is a schematic diagram of housing, which shows communication relations among chambers formed inside a housing of the power unit.

The following is descriptions of a breather structure provided to the power unit P. The descriptions are given by referring to a schematic diagram of the FIG. 9 together with others. FIG. 2, FIG. 7 and FIG. 9 illustrates that, inside the crankcase 4, the central separation walls 5*a* and 6*a* separate the crank chamber 24 from transmission chamber 28, but the two chambers 24 and 28 communicate to each other through a communication space 4*a* above the central separation walls 5*a* and 6*a*.

The main shaft 101, the reverse idle shaft 102 and the counter shaft 103 are placed in such positions as their respective shaft centers $O_1$, $O_2$ and $O_3$ being shown in FIG. 2 and FIG. 7. Specifically, the main shaft 101 is placed behind the communication space 4*a*. The reverse idle shaft 102 is placed behind and above the main shaft 101. The counter shaft 103 is placed behind and below the main shaft 101 and the reverse idle shaft 102. The reverse-speed gear train GR is provided to these three shafts 101 to 103, as being shown by a [one-dot] chain line in each of FIG. 2, FIG. 6 and FIG. 8. As being shown in FIG. 2 and FIG. 6, the inner surface of the upper wall portion 5*g* forming the transmission case 8 is formed so as to follow the shape of the contour of the upper portion of a reverse idle gear 132. The reverse idle gear 132 constantly meshes with a main reverse gear 131 and a counter reverse gear 133. Additionally, as being shown in FIG. 2 and FIG. 7, the starter motor 71 is placed behind the cylinder block 3 with the axis of the starter motor 71 extending in the right and left directions. As a result, the upper wall portion 5*g* forming the transmission case 8 is formed so as to follow the shape of the contour of the lower portion of the starter motor 71.

A small chamber 36 is formed in a position behind and above the crank chamber 24 (i.e. in front of and above the transmission chamber 28, and above the communication space 4*a*) while the small chamber 36 is surrounded by the separation walls 5*i* and 6*i*. Upper wall portions of the transmission case 8, up-and-down extending portions 5*i*1 and 6*i*1, and front-to-rear extending portions 5*i*2 and 6*i*2 constitute the separation walls 5*i* and 6*i*, respectively. The upper wall portions of the transmission case 8 extend rearwards from a fitting opening 4*b* where the cylinder block 3, into which the cylinder sleeve 12 is fitted, is fitted. The up-and-down extending portions 5*i*1 and 6*i*1 extend downwards from the part behind the fitting opening 4*b*, and face a bottom end portion 3*a* of the cylinder block 3 in the assembled state as being shown by two-dot lines in FIG. 7. The front-to-rear extending portions 5*i*2 and 6*i*2 are formed so as to follow the contour of the front upper portion of a drive gear of the fifth-speed gear train G5, which is the gear with the largest diameter among all the gears provided on the main shaft 101. The front-to-rear extending portions 5*i*2 and 6*i*2 extend rearwards and upwards from the bottom ends of the up-and-down extending portions 5*i*1 and 6*i*1 respectively, and then lead to the upper wall portions.

As being shown in FIG. 7, in the separation wall 6*i* formed in the left case 6, a first communication port 93 is formed as penetrating, in the up-and-down directions, the front-and-rear extending portion 6*i*2. Additionally, as being shown in FIG. 2 and FIG. 6, in the side face of the right case 5, specifically, in an area surrounded by the separation wall 5*i* when viewed from a side, a second communication port 94 is formed as penetrating the side face in the right-and-left directions. Moreover, as being shown in FIG. 7 and FIG. 8, in the side face of the left case 6, specifically, in an area surrounded by the separation wall 6*i* when viewed from a side, a third communication port 95 is formed as penetrating the side face in the right-and-left directions.

As being shown in FIG. 8, the third communication port 95 is formed in a position in front of and below the shaft center $O_{72}$ of the first starter idle shaft 72, and behind and above the shaft center $O_{73}$ of the second starter idle shaft 73. The position is close to the extending portion of the left auxiliary apparatus chamber 26. The extending portion is a rear and upper portion of the left auxiliary apparatus chamber 26, and is surrounded by the motor bracket 6*b*. Additionally, in the side face of the left case 6, a fourth communication port 96 is formed so as to allow the crank chamber 24 communicate to a front and upper portion of the left auxiliary apparatus chamber 26. Moreover, in the side face of the left case 6, a fifth communication port 97 is formed so as to allow the crank chamber 24 communicate to a front and lower portion of the left auxiliary apparatus chamber 26.

In addition, inside the crankcase 4, specifically, in a rear upper portion thereof, the breather chamber 30 is formed as being surrounded by separation walls 5*j*, 5*k* and 6*j*. As being shown in FIG. 2 and FIG. 7, the separation walls 5*j* and 6*j* formed respectively on the left side face of the right case 5 and on the right side face of the left case 6 have the following configurations. Each of the separation walls 5*j* and 6*j* includes a corresponding part of each of the upper wall portions 5*g* and 6*g*, as well as a corresponding part of each of the rear wall portions 5*e* and 6*e*, all of which constitute the rear upper end of the transmission case 8. Additionally, each of the separation walls 5*j* and 6*j* includes a corresponding one of up-and-down extending portions 5*j*1 and 6*j*1, each of which extends rearwards and downwards from the corresponding one of the upper wall portions 5*g* and 6*g*, as following the contour of the rear portion of the reverse idle gear 102. Moreover, each of the separation walls 5*j* and 6*j* includes a corresponding one of front-to-rear extending portions 5*j*2 and 6*j*2. Each of the front-to-rear extending portions 5*j*2 and 6*j*2 extends rearwards from the corresponding one of the bottom ends of respective up-and-down extending portions 5*j*1 and 6*j*1. The front-to-rear extending portion 5*j*2 and 6*j*2 extend as following the contour of the upper portion of the driven gear of the first-speed gear train G1, which gear has the largest diameter among all the gears provided on the counter shaft 103. Meanwhile, as being shown in FIG. 6, the separation wall 5*k* provided on the right side face of the right case 5, includes a upper extending portion 5*k*1 and a lower extending portion 5*k*2. The upper extending portion 5*k*1 extends from a rear upper portion of the ribbed attachment 5*n* for right cover, as following the contour of the upper portion of the reverse idle gear 132. The lower extending portion 5*k*2 extends rearwards from the front end of the upper extending portion 5*k*1, then extends as following the contour of the reverse idle gear 132, and then extends further rearwards.

A plate 16 is joined, from the right, to an area A surrounded by the separation wall 5*k* when viewed from a side, with a bolt inserted into a screw hole 5*m* formed in an upper end portion of the separation wall 5*k*. In this way, what is formed inside the right auxiliary apparatus chamber 25, is a breather auxiliary chamber 38, delimited as being surrounded by the right side face of the right case 5, the separation wall 5*k* and the plate 16.

Figure 6:
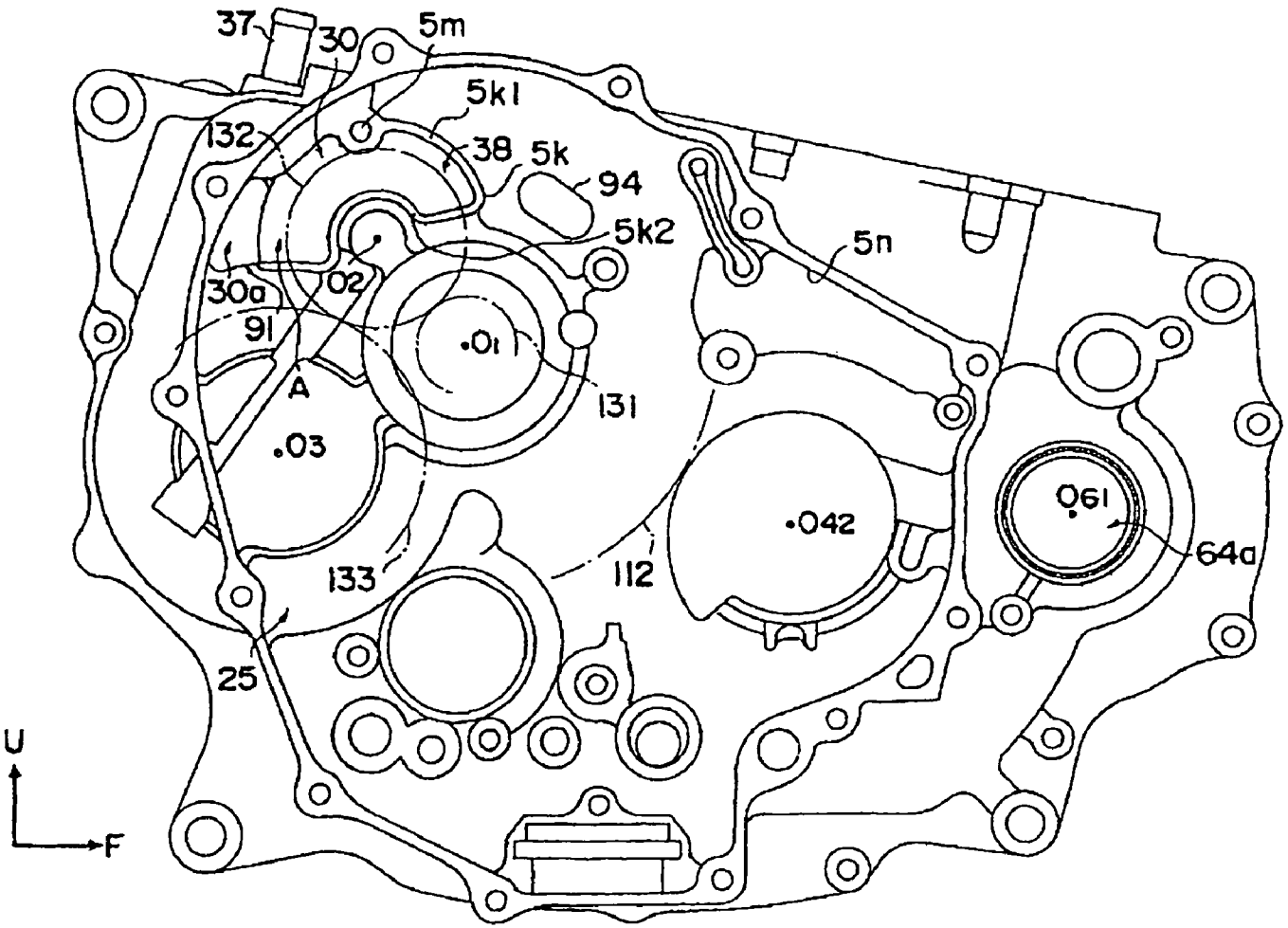
FIG. 6 is a right side view of the right case.

As being shown in FIG. 6, this breather auxiliary chamber 38 has a shape overlapping the contour of the outer circumference of the reverse idle gear 132 when viewed from a side. Additionally, a cut-away portion is formed in the rear end portion of the lower extending portion 5*k*2 of the separation wall 5*k*. This cut-away portion is made to be a breather entrance port 91 allowing communication between the right auxiliary apparatus chamber 25 and the breather auxiliary chamber 38. The breather auxiliary chamber 38 communicates to the breather chamber 30 formed inside the crankcase 4 via a penetrating port 30*a*, which is formed in the side face of the right case 5 penetrating the right case 5 in the right and left directions.

As being shown in FIG. 2 and FIG. 7, a plurality of passage-forming ribs 5*l*, sticking out inside the breather chamber 30, are formed on the separation wall 5*j* formed on the left side face of the right case 5 while a plurality of passage-forming ribs 6*l*, sticking out inside the breather chamber 30, are formed on the separation wall 6*j* formed on the right side face of the left case 6. In a rear end portion of the front-to-rear extending portion 6*j*2 of the separation wall 6*j* formed on the right side face of the left case 6, an oil-returning hole 98 is formed so as to penetrate the left case 6 in the up-and-down direction. In an upper wall portion 5*g* of the transmission case 8, a breather exit port 92 is formed so as to penetrate the upper wall portion 5*g* in the up-and-down direction. A pipe coupling member 37, which has a pipe shape, is press-fitted into this breather exit port 92. The pipe coupling member 37 has a first end as an opening inside the breather chamber 30, and a second end as an opening outside the crankcase 4. An opening at a first end of an unillustrated breather pipe is coupled to the second end of the pipe coupling member 37 while an opening at the second end of the breather pipe is coupled to the air cleaner.

In the breather structure, as being shown in FIG. 2, constituted by the above-described chambers arranged as being described above, each of the small chamber 36 and the breather chamber 30 is formed by delimiting the inside of the crankcase 4 (transmission case 8). The small chamber 36 and the breather chamber 30 are placed on either side of the reverse idle gear 132, with the small chamber 36 being in front of and the breather chamber 30 being behind the reverse idle gear 132. The breather auxiliary chamber 38 is formed as overlapping the reverse idle gear 132 when viewed from a side. The small chamber 36 is formed between the starter motor 71 and the gears provided on the main shaft 101 and on the reverse idle shaft 102. The breather chamber 30 is formed in outer circumferential portions of the gears provided on the reverse idle shaft 102 and on the counter shaft 103.

The housing H is formed by coupling the right case 5 to the left case 6, both of which are shaped as described above. When the engine E housed in the housing H operates, the piston 41 travels downward inside the cylinder bore 21. This brings about an increase in the internal pressure of the crank chamber 24, which communicates to the cylinder bore 21 via the piston 41. As a result, an increase in the internal pressure of the transmission chamber 28 is brought about, because the communication space 4*a* allows the transmission chamber 28 and the crank chamber 24 to communicate to each other. Here, the transmission chamber 28 is allowed to communicate to the small chamber 36 through the first communication port 93, so that the increased internal pressure of the transmission chamber 28 escapes to the small chamber 36.

Additionally, the crank chamber 24 is allowed to communicate to the left auxiliary apparatus chamber 26 via the fourth and the fifth communication ports 96 and 97. With this configuration, when the internal pressure of the crank chamber 24 is increased, the pressure escapes to the left auxiliary apparatus chamber 26 via the fourth communication port 96 and the fifth communication port 97. The left auxiliary apparatus chamber 26 is allowed to communicate to the small chamber 36 via the third communication port 95. The small chamber 36 functions as follows. According to the difference in pressure between the small chamber 36 and the left auxiliary apparatus chamber 26, the pressure inside the small chamber 36 escapes to the left auxiliary apparatus chamber 26, or the pressure inside the left auxiliary apparatus chamber 26 escapes to the small chamber 36.

This small chamber 36 is allowed to communicate to the right auxiliary apparatus chamber 25 via the second communication port 94. The right auxiliary apparatus chamber 25 is allowed to communicate to the breather auxiliary chamber 38 via the breather entrance port 91. Here, as the second communication port 94 is formed in an area surrounded by the separation wall 5*i* when viewed from a side, the second communication port 94 is positioned close to the contour of the upper portion of each of the gears provided on the main shaft 101, and to the front end portion of the reverse idle gear 132.

Since the right auxiliary apparatus chamber 25 is allowed to communicate to the crank chamber 24 via the small chamber 36, the internal pressure of the right auxiliary apparatus chamber 25 is much lower than that of the crank chamber 24. As a result, the change of pressure becomes smaller than otherwise, but the internal pressure of the right auxiliary apparatus chamber 25 escapes further to the breather auxiliary chamber 38 via the breather entrance port 91 and to the breather chamber 30 via the penetrating port 30*a*. The air flown into the breather chamber 30 with such a drop in pressure proceeds to pass through a zigzag passage formed by delimiting with the passage-forming ribs 5*l* and 6*l*. While the air flown from the crank chamber 24 passes through the zigzag passage, the lubricating-oil mist contained in the air is deposited on the passage-forming ribs 5*l* and 6*l* as droplets. The lubricating oil having turned into droplets falls into the transmission chamber 28 through the oil-returning hole 98 formed in the separation wall 6*j* of the left case 6. The lubricating oil droplets then slide down the inner surface of the rear wall portion 6*e* of the left case 6, and then return to the oil reservoir 35 formed in a lower portion of the transmission chamber 28. Note that FIG. 9 shows, just schematically, that the zigzag passage is formed inside the breather chamber 30. In other words, FIG. 9 does not show the exact passage that is actually formed when the right case 5 shown in FIG. 2 is coupled to the left case 6 shown in FIG. 7.

The air from which the lubricating oil is removed when the air passes through the zigzag passage formed inside the breather chamber 30 is discharged to the outside of the housing H through the breather exit port 92. The air discharged outside the housing H is then led to the air cleaner through an unillustrated breather pipe. The air led to the air cleaner is supplied again to the combustion chamber 22 in an intake stroke. The fuel components flown into the crank chamber 24 leaking from the combustion chamber 22 through the interstice between the piston 41 and cylinder sleeve 12 is supplied to the combustion chamber 22 in this manner to be combusted again.

In such a breather structure, the transmission chamber 28, which is allowed to communicate to the crank chamber 24, is allowed to communicate to the small chamber 36 through the first communication port 93. The small chamber 36 is allowed to communicate to the right auxiliary apparatus chamber 25, in which the main clutch 115 is housed, through the second communication port 94. This right auxiliary apparatus chamber 25 is allowed to communicate the breather chamber 30 allowed to communicate to the outside of the housing H.

Accordingly, an increased internal pressure of the transmission chamber 28 allowed to communicate to the crank chamber 24 can be lowered down with the small chamber 36, and can be further lowered down, to a greater extent, with the right auxiliary apparatus chamber 25, which has a large capacity. In this way, with the small chamber 36 and the right auxiliary apparatus chamber 25, the pressure can be relaxed more effectively than otherwise. In addition, the breather chamber 30 can be made smaller than otherwise. As a result, the housing H, as a whole, can be made smaller than otherwise, can be mounted onto a vehicle with greater ease, and can be produced at a lower cost.

Additionally, the crank chamber 24 is allowed to communicate to the transmission chamber 28 in which the constituent shafts of the transmission mechanism 120 are housed. Specifically, the main shaft 101, the reverse idle shaft 102 and the counter shaft 103 are housed therein. In the above-described configuration, the small chamber 36 is formed so as to follow the contour of each of the gears provided on the main shaft 101 and the reverse idle shaft 102. In addition, the breather chamber 30 is formed so as to follow the contour of each of the gears provided on the reverse idle shaft 102 and the counter shaft 103. In this way, the small chamber 36 and the breather chamber 30 are formed in a dead space formed outside the contour of each gear, so that the dead space can be used effectively to relax the internal pressure. Additionally, no special housing member is needed to form the small chamber 36 and the breather chamber 30. This makes it possible to provide an engine E with an excellent breathing effect without increasing the number of component parts.

Moreover, since the constituent shafts of the transmission mechanism 120, that is, the shafts 101 to 103, are provided inside the transmission chamber 28, which is allowed to communicate to the crank chamber 24, the gear trains G1 to G5 and GR provided across these shafts are housed in the transmission chamber 28. In the above-described configuration, the second communication port 92, which allows the small chamber 36 to communicate to the right auxiliary apparatus chamber 25, is formed at a position close to the front end portion of the reverse idle gear 132. In addition, the breather entrance port 91, which allows the right auxiliary apparatus chamber 25 to communicate to the breather auxiliary chamber 38, is formed at a position close to the rear end portion of the reverse idle gear 132. In this way, the distance between these two communication ports can be made as long as the distance equivalent to that between the front and the rear ends of the reverse idle gear 132. In addition, use of the right auxiliary apparatus chamber 25, in which a large auxiliary apparatus, specifically, the main clutch 115, is housed, and which has a large capacity, makes it possible to effectively mitigate the fluctuation of the internal pressure.

Furthermore, the breather auxiliary chamber 38, which is allowed to communicate to the breather chamber 30, is formed so as to overlap this reverse idle gear 132 when viewed from a side. In this way, the chamber allowed to communicate to the breather chamber 30 is formed by making effective use of the dead space formed outside the contour of each of the gears. The mitigation of the pressure fluctuation is pursued by the chamber thus formed, and the capacity of the breather chamber 30 can be made smaller. As a result, an engine E with an excellent breathing effect, and at the same time with a smaller size, can be provided.

Still furthermore, the crank chamber 24 is allowed to communicate to the left auxiliary apparatus chamber 26, in which the AC generator 86 and the starter reduction mechanism are housed, through the fourth and the fifth communication ports 96 and 97. In addition, this left auxiliary apparatus chamber 26 is allowed to communicate to the small chamber 36 through the third communication port 95. Accordingly, the pressure increased inside the crank chamber 24 can be reduced by making use of the left auxiliary apparatus chamber 26. As a result, the pressure fluctuation inside the right auxiliary apparatus chamber 25 can be mitigated to a greater extent, and the capacity of the breather chamber 30 can be made even smaller.

Even still furthermore, the third communication port 95 is formed in a rear upper portion of the left auxiliary apparatus chamber 26. Meanwhile, the fourth communication port 96 is formed in a front upper portion of the left auxiliary apparatus chamber 26, and the fifth communication port 97 is formed in a front lower portion of the left auxiliary apparatus chamber 26. In this way, the distance between any two of the third, the fourth and the fifth communication ports 95, 96 and 97 is elongated, so that the mitigation of the fluctuation in the internal pressure can be carried out effectively with use of the left auxiliary apparatus chamber 26. The mitigation can be carried out effectively because nearly the whole part of the left auxiliary apparatus chamber 26 is used, and additionally, the left auxiliary apparatus chamber 26 has a large capacity as the left auxiliary apparatus chamber 26 houses the AC generator 86, which is a large auxiliary apparatus.

Incidentally, in the power unit P of the present configuration, the primary gear train 110 and the main clutch 115 are provided in the right auxiliary apparatus chamber 25, while the AC generator 86 is provided in the left auxiliary apparatus chamber 26. The present invention is not limited to such a configuration. As long as each of the right auxiliary apparatus chamber 25 and the left auxiliary apparatus chamber 26, with a large auxiliary apparatus installed therein, has a large enough capacity to mitigate effectively the fluctuation in the internal pressure, the present invention can be carried out in a similar way. For example, for transmitting the rotation of the crankshaft 42 to the main shaft 101, a metal V-belt mechanism may replace the primary gear train. Alternatively, a torque converter, or a centrifugal clutch, may replace the primary gear train.

What is claimed is:

1. A breather structure for an internal combustion engine, provided in a housing of an internal combustion engine, which housing includes:

a cylinder block having a cylinder bore with a piston reciprocally disposed therein; and a case joined to the cylinder block with a crank chamber in communication with the cylinder bore, said case being formed to house a crankshaft rotating in conjunction with the piston, said breather structure of the internal combustion engine being capable of mitigating the fluctuation in an internal pressure in the crank chamber by allowing the crank chamber to communicate to an outside of the housing, the breather structure of the internal combustion engine comprising:

a power transmission system having a power transmission route including a plurality of shaft members and a transmission mechanism to transmit the power among the crankshaft and the plurality of shafts members, and which power transmission system transmits the torque of the crankshaft to a wheel via the power transmission route; and a first side face cover joined to the case while covering a first one of a right and a left side faces of the case, and in which an auxiliary apparatus chamber is formed to house a clutch mechanism connecting and disconnecting the power transmission route, wherein a breather chamber and a small chamber are formed inside the housing in positions that are above the crankshaft, with the breather chamber having an external communication port formed therein to communicate to the outside of the housing, and the small chamber communicating both to the crank chamber and to the auxiliary apparatus chamber, wherein the small chamber communicates to the crank chamber in an up-and-down direction via a communication port penetrating through a lower surface of the small chamber, and wherein the breather chamber communicates to the small chamber via the auxiliary apparatus chamber.

2. The breather structure for the internal combustion engine, as recited in claim 1, wherein the small chamber is formed inside the case.

3. The breather structure for the internal combustion engine, as recited in claim 2, wherein gears constituting the transmission mechanism are housed in the crank chamber; and wherein a breather entrance port, allowing the auxiliary apparatus chamber to communicate to the breather chamber, is formed on a first side of the gears, while a communication port, allowing the small chamber to communicate to the auxiliary apparatus chamber, is formed on a second side of the gears.

4. The breather structure for the internal combustion engine, as recited in claim 3, wherein a breather auxiliary chamber, communicating to the auxiliary apparatus chamber through the breather entrance port, and to the breather chamber through a predetermined communication port, is formed, in an area overlapping the gears when viewed from a side, by delimiting an inside of the auxiliary apparatus chamber.

5. The breather structure for the internal combustion engine, as recited in claim 1, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

6. The breather structure for the internal combustion engine, as recited in claim 2, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

7. The breather structure for the internal combustion engine, as recited in claim 3, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

8. The breather structure for the internal combustion engine, as recited in claim 4, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

9. The breather structure for the internal combustion engine, as recited in claim 1, wherein the breather chamber is disposed in a position substantially above a counter shaft of the internal combustion engine.

10. A breather structure for the internal combustion engine, provided in a housing of an internal combustion engine, which housing includes:

a cylinder block having a cylinder bore with a piston reciprocally disposed therein; and a case joined to the cylinder block with a crank chamber in communication with the cylinder bore, said case being formed to house a crankshaft rotating in conjunction with the piston, said breather structure of the internal combustion engine being capable of mitigating the fluctuation in an internal pressure in the crank chamber by allowing the crank chamber to communicate to the outside of the housing, the breather structure of the internal combustion engine comprising:

a power transmission system having a power transmission route including a plurality of shaft members and a transmission mechanism to transmit the power among the crankshaft and the plurality of shafts members, and which power transmission system transmits the torque of the crankshaft to a wheel via the power transmission route; and a first side face cover joined to the case while covering a first one of a right and a left side faces of the case, and in which an auxiliary apparatus chamber is formed to house a clutch mechanism connecting and disconnecting the power transmission route, wherein a breather chamber and a small chamber are formed inside the housing, with the breather chamber having an external communication port formed therein to communicate to the outside of the housing, and the small chamber communicating both to the crank chamber and to the auxiliary apparatus chamber, and wherein the breather chamber communicates to the small chamber via the auxiliary apparatus chamber, further comprising a breather auxiliary chamber disposed between the auxiliary apparatus chamber and the breather chamber, wherein a breather entrance port is provided at an upper portion of one side of the breather auxiliary chamber in order to allow the auxiliary apparatus chamber to communicate with the breather auxiliary chamber, wherein a predetermined communication port is provided on an upper portion of an opposite side of the breather auxiliary chamber in order to allow the breather auxiliary chamber to communicate with the breather chamber, and wherein the breather chamber is disposed rearwardly with respect to a reverse idle shaft.

11. A breather structure for an internal combustion engine, provided in a housing of an internal combustion engine, said housing comprising:

a cylinder block having a cylinder bore with a piston reciprocally disposed therein; and a case joined to the cylinder block, with a crank chamber in communication with the cylinder bore, said case being formed to house a crankshaft rotating in conjunction with the piston, said breather structure of the internal combustion engine being capable of mitigating the fluctuation in the internal pressure in the crank chamber by allowing the crank chamber to communicate to the outside of the housing, the breather structure of the internal combustion engine comprising:

a power transmission system which has a power transmission route including a plurality of shaft members and a transmission mechanism to transmit the power among the crankshaft and the plurality of shafts members, and which power transmission system transmits the torque of the crankshaft to a wheel via the power transmission route; and a first side face cover joined to the case while covering a first one of a right and a left side faces of the case, and in which an auxiliary apparatus chamber is formed to house a clutch mechanism connecting and disconnecting the power transmission route, wherein a breather chamber and a small chamber are formed inside the housing in positions that are above the crankshaft, with the breather chamber having an external communication port formed therein to communicate to the outside of the housing, and the small chamber communicating both to the crank chamber and to the auxiliary apparatus chamber, wherein the breather chamber communicates to the small chamber via the auxiliary apparatus chamber, wherein the small chamber communicates to the crank chamber in an up-and-down direction via a communication port penetrating through a lower surface of the small chamber, and wherein a plurality of passage-forming ribs stick out inside the breather chamber.

12. The breather structure for the internal combustion engine, as recited in claim 11, wherein the small chamber is formed inside the case.

13. The breather structure for the internal combustion engine, as recited in claim 12, wherein gears constituting the transmission mechanism are housed in the crank chamber; and wherein a breather entrance port, allowing the auxiliary apparatus chamber to communicate to the breather chamber, is formed on a first side of the gears, while a communication port, allowing the small chamber to communicate to the auxiliary apparatus chamber, is formed on a second side of the gears.

14. The breather structure for the internal combustion engine, as recited in claim 13, wherein a breather auxiliary chamber, communicating to the auxiliary apparatus chamber through the breather entrance port, and to the breather chamber through a predetermined communication port, is formed, in an area overlapping the gears when viewed from a side, by delimiting an inside of the auxiliary apparatus chamber.

15. The breather structure for the internal combustion engine, as recited in claim 11, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

16. The breather structure for the internal combustion engine, as recited in claim 12, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

17. The breather structure for the internal combustion engine, as recited in claim 13, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

18. The breather structure for the internal combustion engine, as recited in claim 14, further comprising:

a second side face cover, which is joined to the case as covering a second one of the right and the left side faces of the case, wherein a second auxiliary apparatus chamber is formed to house an auxiliary apparatus of the internal combustion engine, and wherein the small chamber communicates to the second auxiliary apparatus chamber.

19. The breather structure for the internal combustion engine, as recited in claim 11, wherein the breather chamber is disposed in a position substantially above a counter shaft of the internal combustion engine.

20. The breather structure for the internal combustion engine, as recited in claim 11, further comprising a breather auxiliary chamber disposed between the auxiliary apparatus chamber and the breather chamber, wherein a breather entrance port is provided at an upper portion of one side of the breather auxiliary chamber in order to allow the auxiliary apparatus chamber to communicate with the breather auxiliary chamber, wherein a predetermined communication port is provided on an upper portion of an opposite side of the breather auxiliary chamber in order to allow the breather auxiliary chamber to communicate with the breather chamber, and wherein the breather chamber is disposed rearwardly with respect to a reverse idle shaft.

* * * * *